United States Patent [19]

Craycroft et al.

[11] Patent Number: 4,816,035

[45] Date of Patent: Mar. 28, 1989

[54] PROCESS FOR RAPID DYEING FROM ENTRAINED COMPOSITIONS OF HIGH-BOILING SOLVENTS

[75] Inventors: Robert S. Craycroft, Sophia; Tina V. Lorenzo, Jamestown; John H. Hansen; Earnest J. Russell, both of Greensboro, all of N.C.

[73] Assignee: Burlington Industries, Inc., Greensboro, N.C.

[21] Appl. No.: 67,799

[22] Filed: Jun. 30, 1987

[51] Int. Cl.[4] ..... D06M 13/00

[52] U.S. Cl. ..... 8/938; 8/920; 8/115.6

[58] Field of Search ..... 8/115.6, 127.1, 440, 8/142, 505, 932, 938; 252/8.9

[56] References Cited

U.S. PATENT DOCUMENTS 4,047,889 9/1977 Hermes ..... 8/115.6

4,293,305 10/1981 Wilson ..... 8/440

FOREIGN PATENT DOCUMENTS 0159876 10/1985 European Pat. Off. .

*Primary Examiner*—Paul Lieberman
*Assistant Examiner*—John F. McNally
*Attorney, Agent, or Firm*—Nixon & Vanderhye

[57] ABSTRACT

Textile fabrics such as polyester, nylon and high-tenacity nylon are continuously dyed using a non-aqueous dye composition at elevated temperatures in an air atmosphere. The non-aqueous dye composition consisting of high-boiling, nonionic solvent and a dye, is applied to the textile in an air atmosphere at a temperature below 280° F. then, while the dye composition is entrained in the fabric, the fabric is heated also in an ambient atmosphere to effective dyeing. Non-reactive environments or inert temperatures are not required.

11 Claims, 2 Drawing Sheets

PROCESS FOR RAPID DYEING FROM ENTRAINED COMPOSITIONS OF HIGH-BOILING SOLVENTS

BACKGROUND OF THE INVENTION

This invention relates to the dyeing of textile fibers and fabrics. More specifically, described is a process for rapid dyeing of textiles from entrained high-boiling solvents which is conducted on a continuous basis and optionally simultaneously heat-sets the fabric while the fabric is being dyed. Unlike prior procedures, no special precautions are required to isolate the dye composition from the atmosphere. This process results in level, uniform dyeing free from end-to-end variations and side-to-center-to-side shade changes. Deterioration of the dyes, easily detected by color change, was not observed. Moreover, shade matches are readily obtained.

Dyeing processes currently in use in the textile industry are often limited in performance by several fundamental factors. Aqueous dyeing processes at atmospheric pressure are limited in that the dyeing temperature is necessarily maintained below the boiling point of water. Since dye penetration of the fiber is often slow at such temperatures, batch processes with long dwell times are common. Pressurized aqueous dyeing processes offer the advantage of increased dyeing temperature and thus, dyeing rate. However, the design of pressurized vessels restricts such processes to operation in the batch mode. Additionally, dyeing temperatures are still relatively low so that long dwell times are common. In order to minimize the number and size of costly batch dyeing machines required, such machines are designed to maximize the amount of fabric that can be processed. Thus, batch processes often operate so that the fabric is dyed in rope form. Rope dyeing promotes non-uniform coloring of the fabric due to inconsistent contact with dye liquor across the fabric width. Batch processes often require large volumes of dye liquor, which imposes additional costs for heating the dye liquor and for disposal of waste liquors.

A continuous, open-width dyeing process which overcomes the temperature limitation of aqueous processes is the well-known thermosol process. One disadvantage of this process is that it is suited for only a small selection of dyestuffs and fibers. Additionally, the thermosol process is energy intensive in that the fabric must be dried before dyeing can occur. Another disadvantage of the drying step is that poor uniformity often occurs due to dye migration resulting from uneven drying.

Continuous dyeing processes in general suffer from end-to-end shade variations due to depletion of dye liquors, commonly called tailing, and from difficulty in adjusting and controlling dye liquor concentrations. A related problem is one of predictability—dyeing recipes formulated in the laboratory often produce different results in the production process.

A problem common to textile dyeing processes in general is that the fabric heat history prior to dyeing affects the shade obtained upon dyeing.

Another type of dyeing procedure uses a non-aqueous system that operates at elevated temperatures. The non-aqueous dye compositions consist of a dye or several dyes dissolved or usually dispersed in a high-boiling, nonionic, organic solvent. This class of solvents is described in various U.S. patents, of which U.S. Pat. No. 4,293,305 to Wilson is typical. Additional related patents are identified in more detail below.

More recently, Clifford in U.S. Pat. No. 4,550,529 proposes to dye shaped articles using these non-aqueous dyeing compositions composed of a dyestuff and a high-boiling, nonionic solvent in a non-reactive environment in order to overcome problems of stability of the dye composition at elevated temperatures. Specifically, Clifford states that the dye composition based upon certain high-boiling aromatic esters or cycloaliphatic diesters does not remain stable over a period of time when used at high temperatures in an air atmosphere and, in fact, significant degradation of the dye composition can be expected after only a few hours of use. These dye compositions are frequently used and recirculated while being maintained at temperatures in the range of from 350°–380° F.

In related published European Application No. 159,876 to Pensa et al., the importance of a non-reactive environment, such as achieved with Freon® TF (DuPont), is demonstrated in a series of comparative examples. This patent reports significant loss of color strength for high-boiling aromatic ester dye compositions after being exposed to the air for a period of four hours.

Thus, the art clearly teaches the importance of using such high-boiling dye compositions in a non-reactive, inert environment.

We have discovered a process by which textile articles are rapidly and continuously dyed in open width, and optionally simultaneously heat set, using dye compositions based upon high-boiling, nonionic organic solvents in a normal air atmosphere. Special precautions for maintaining a non-reactive environment are not required.

In the process of the present invention, the dye composition is preferably prepared, held, and applied to the textile at a relatively low temperature, typically 200 to 250° F., at which degradation of the dye composition is negligible. A minimal amount of dye composition, typically less than one pound of dye composition per pound of textile, is applied to the textile, preferably by padding, and is indirectly heated with the textile to the dyeing temperature, e.g., by impinging hot air. In this manner, a minimum amount of dye composition is exposed to dyeing temperature and for only a very short period of time, typically 30 to 60 seconds.

By contrast, in the preferred embodiment of the process of EPA 159,876, the dye composition is maintained at the dyeing temperature (page 28, line 19) during the entire operation of the process. Thus, the dye composition is continuously maintained at a temperature at which it is susceptible to degradation. Also, a thin continuous film of dye composition that flows over all of the surfaces of the textile to be dyed illustrates that an excess of dye composition is contacted with the material and is necessarily exposed to the dyeing temperature.

Rapid dyeing from high-boiling solvents has previously been disclosed by Hermes of Martin Processing. U.S. Pat. No. 4,047,889 discloses a general process including scouring, recovery, and recycling. The entire process is conducted under closed conditions.

U.S. Pat. No. 4,055,971, also to Hermes, describes specific apparatus for implementing the process disclosed in U.S. Pat. No. 4,047,889 above. Also, U.S. Pat. No. 4,047,889 refers to dyeing apparatus disclosed in U.S. Pat. No. 3,558,260. The disclosures refer to two methods of contacting textiles with dye compositions:

immersion, in which dye is transferred from dyebath to an immersed textile; and cascade, in which dye is transferred from dye composition continuously sprayed over the textile. These two contacting schemes are dynamically similar in that the textile is contacted with a large excess of dye liquor which changes only very slowly in concentration with time. By contrast, the entrainment method of contact of the present invention utilizes a carefully controlled minimum amount of dye composition which changes substantially in concentration as dye is transferred from the entrained dyebath to the textile. Due to the concentration change, the entrainment dyeing process is not easily understood without consideration of fundamental mass transfer principles. To our knowledge, the feasibility and advantages of contact by entrainment in solvent dyeing have not previously been recognized.

SUMMARY OF THE INVENTION

It is therefore an object of the present invention to provide an improved process for the dyeing of shaped textiles at an elevated temperature under atmospheric conditions in which the dye composition does not undergo significant degradation.

It is an object of the present invention to provide a process for the non-aqueous dyeing of textiles at an elevated temperature under atmospheric conditions that allows for the recycling of the dye composition without significant degradation of the dyestuff.

Additional objects and advantages of the invention will be set forth in part in the description that follows and in part will be obvious from the description, or may be learned by practice of the invention. The objects and advantages of the invention may be realized and obtained by means of instrumentalities and combinations particularly pointed out in the appended claims.

DETAILED DESCRIPTION OF THE DRAWINGS

Figure 1:
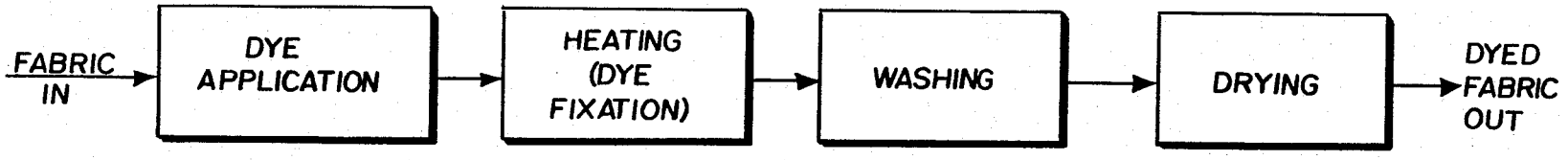
FIG. 1 is a block diagram illustrating the operative steps for the entrainment dyeing process of the invention.

FIG. 1 shows, in stepwise manner, the operative and required steps of the present invention. The dye is applied using a carefully calculated, correct amount of dye composition to adequately impregnate the fabric with a predetermined quantity of dye liquor. Typically, the dye liquor is applied from a pad bath. The dye-entrained fabric is then heated to transfer the dye from the carrier liquid to the fibers of the fabric and, if the fabric is dimensionally controlled, heat-set the fabric. Scouring with an organic solvent to dissolve any residual dye composition follows, including recovery of the solvent and recovery of the dye composition. The dyed fabric is then dried and accumulated.

Figure 2:
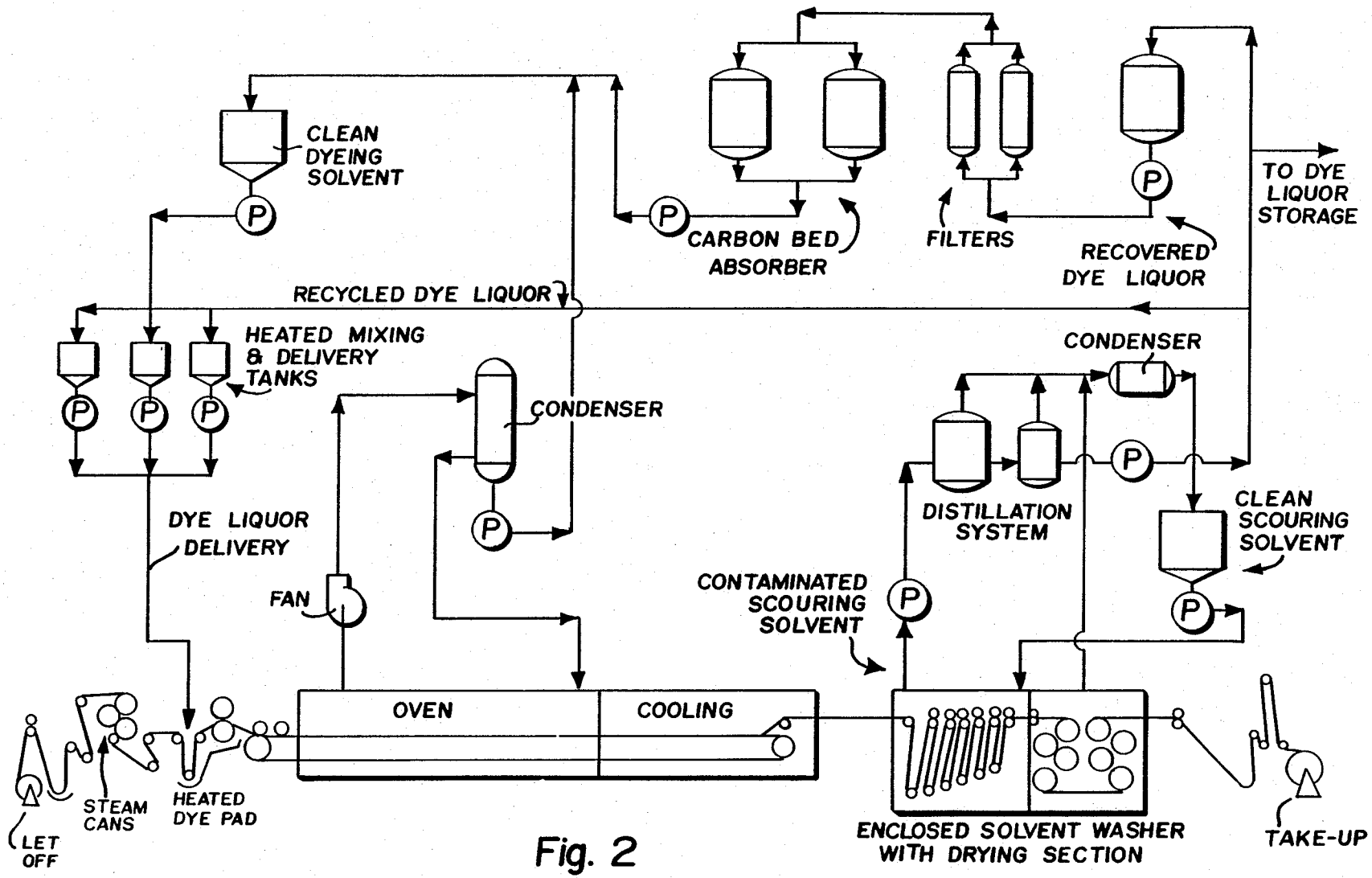
FIG. 2 is a schematic illustration of the equipment for conducting the entrainment dyeing process according to a preferred aspect of the present invention.

In FIG. 2, from left to right, a supply of fabric is accumulated and then continuously led into a heated dye pad bath. The dye liquor is prepared from recycled dye composition plus additional make-up high-boiling nonionic solvent and dyes, as required. The dye composition is then heated and mixed in a mix tank and supplied to the heated dye pad. Wet pickup is adjusted in the dye pad in order to achieve the predetermined level, as explained below. In the embodiment illustrated, a tenter frame is used to provide dimensional stability to the fabric and very quickly complete the dyeing operation and heat-set the fabric in a simultaneous operation. The tenter oven utilizes heated atmospheric air. Air is continuously withdrawn from the tenter oven enclosure and passed through a condenser to recover any of the high-boiling dyeing solvent that evaporates from the fabric. Air exiting the condenser is returned to the oven enclosure. Residual dye liquor is removed from the fabric in the solvent washer using a scouring solvent that dissolves dyes and is miscible with the high-boiling liquid. Acetone is the preferred scouring solvent due to its effectiveness in removing both dyes and high-boiling solvents. Alternatively, a halogenated solvent, such as perchloroethylene, can be used as the scouring solvent followed by washing in an aqueous soap solution. The aqueous wash removes unfixed dyes remaining on the fabric after washing in a halogenated solvent. After washing, the fabric is dried on a series of drying cylinders and finally, is accumulated and taken-up on a roll.

Contaminated scouring solvent leaving the washer is distilled to separate clean scouring solvent from the dye liquor. Scouring solvent vaporized in the still and in the drying section is condensed and recycled to the supply tank for reuse in the washer. Under normal continuous operation, the partially exhausted dye liquor leaving the still is recycled to the mixing tanks where additional dyes and high-boiling solvent are added as needed before delivering to the dye pad. Three separate mixing tanks are used for continuous operation so that the first tank is delivering dye liquor to the pad, the second tank is collecting recycled dye liquor, and the third tank is approximately full of recycled dye liquor which is being prepared for delivery by the addition of dyes and dyeing solvent as required. At the end of a run, the partially exhausted dye liquor leaving the still can be stored for later reuse, or clean dyeing solvent can be reclaimed. To reclaim dyeing solvent, the recovered dye liquor is filtered to remove particulate dyestuffs, which can be disposed of or reused. Then the dyes remaining in solution in the dye liquor are absorbed in the carbon bed and clean dyeing solvent is recycled for reuse.

In general, the apparatus for the entrainment dyeing process consists of an applicator for impregnating the fabric with dye liquor and a heating zone for heating the fabric and entrained liquor to high temperature. The dye liquor is composed of suitable dyes dissolved or dispersed in a high-boiling solvent, such as a high-boiling ester.

The applicator can be any means of uniformly applying dye liquor to the fabric so that the liquor is entrained by the fabric. Examples of suitable applicators include, but are not limited to, a pad, kissroll, or spray apparatus of the type described in copending application Ser. No. 932,020, filed Nov. 18, 1986. A pad application generally requires that the dye liquor be maintained at relatively low temperature (e.g., 250° F.) in order to minimize tailing of the pad bath and to avoid damage or shrinkage of the fabric. Alternatively, the liquor can be applied at high temperature by use of a topical applicator. By topical applicator, we mean all applicators which impregnate the fabric with dye liquor without causing the fabric to be immersed in the dye liquor. Two or more applicators may be included to facilitate fast color change.

The heating zone consists of a means of heating the fabric and entrained liquor to a sufficiently high temperature (e.g., 350° F.) so that dye is rapidly transferred from the liquid into the fiber. The fabric can be heated by any suitable means utilizing one or more of the three heat transfer mechanisms: conduction, convection, or radiation. Examples of common, commercially available equipment utilizing these mechanisms include steam cans, gas recirculating ovens, and infrared heaters, respectively. A tenter frame oven is preferred.

Since shrinkage of most fabrics will occur when dyeing is performed at elevated temperature, it is desirable in some cases to provide a means of dimensional control during dyeing. A conventional tenter mechanism is suitable for providing control of fabric dimensions and, in fact, the use of a tenter allows the fabric to be heat-set simultaneously with dyeing. Alternatively, the fabric can be heat-set separately from the dyeing step, in which case the fabric can be dyed unrestrained at high temperature.

A mathematical model has been developed which has been useful in the development of this process. As explained in more detail below, the model calculates dye concentrations in the fiber and liquid phases for any given process conditions of concentration, time, phase ratio (liquor ratio, wet pickup), and temperature. One advantage realized during the development stage is the adjustment of dye formulations from lab conditions to process conditions to match shades without use of trial and error or empirical techniques. Other advantages include evaluation of various process designs, interpretation of misleading experimental results, and potential use in a feed-forward control system. The model can be used to calculate the effects of a wide range of process conditions because it is derived from consideration of the fundamental mechanisms of mass transfer, rather than on simple regression analysis of empirical data. New analytical techniques were developed to measure dye concentrations in the fiber and liquid phases in order to generate rate and equilibrium data for the model. This model is applicable to mass transfer processes in general, not just to the special case of dye transfer from solvent to fiber.

A wide variety of fabrics are suited to the process of this invention including, but not limited to, those made of fibers that are difficult to dye such as polyester and nylon. In particular, high-tenacity industrial nylon 6,6 fibers are effectively dyed by this process. A widely used example of this type of nylon is DuPont's Cordura®, as described in U.S. Pat. No. 3,433,008.

The process of this invention is generally applicable to any high-boiling solvent, as defined in more detail below, in which dyestuffs or other treatment chemicals can be dispersed or dissolved provided that the system of solvent, dyes and fiber species are chemically compatible. Additionally, there are several possible suitable choices of application and heating equipment. The specific equipment selection will depend on the special needs of the commercial implementation of the process among the products now commercially available. The entire process can be conducted in an air atmosphere, thus avoiding the expense and operational constraints of an inert gas system.

Heat-setting can be done simultaneously or separately from the dyeing process.

As indicated, the liquid component of the dye medium used in the process of this invention is a high-boiling, nonionic organic medium, and by this we mean a composition that remains stable within the temperature range of from about 50° F. to about 450° F. Such high-boiling, nonionic organic solvents are described in the patent literature and elsewhere as vehicles or solvents for dyestuffs and pigments to form waterless dyeing compositions. See, for example, U.S. Pat. No. 4,155,054 to Hermes describing the use of glycol or glycol ethers as high-boiling liquids for waterless dyeing and heat setting of textiles as well as the aromatic esters and cycloaliphatic diesters disclosed in U.S. Pat. No. 4,293,305 to Wilson.

The preferred aromatic esters can be of the formula $ArCOOR_2$, $ArCOO—R_1—OOCAr$ or $(ArCOO)_2$, $—R_3$, wherein $R_1$ is alkylene of 2–8 carbon atoms or polyoxyalkylene of the formula $—C_rH_{2r})_s$, in which r is 2 or 3 and s is up to 15; $R_2$ is substituted or unsubstituted alkyl or alkenyl of 8–30 atoms; $R_3$ is the residue of a polyhydric alcohol having z hydroxyl groups; Ar is mono- or bicyclic aryl of up to 15 carbon atoms and z is 3–6.

Furthermore, the cycloaliphatic ester can be of the formula:

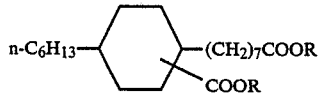

wherein R is substituted or unsubstituted straight or branched chain alkyl of 4–20 carbon atoms, polyoxyalkylene of the formula $R'\ (OC_xH_{2x})_n$ or phosphated polyoxyalkylene of the formula:

$$(HO)_2P(=0)(OC_xH_{2xn}OC_xOC_xH_{2x})$$

or a salt thereof, wherein $(OC_xH_{2x}O)_n$ is $(C_2H_4O)_n—$,$(C_3H_6O)_n—$or $(C_2H_4O)_p$, or $(C_3H_6O)_q—$; $R^1$ is H or ArCO; Ar is mono- or bicyclic aryl of up to 15 carbon atoms; x is 2 or 3; n is 2-22 and the sum of p+q is n.

The preferred high-boiling, nonionic organic solvents include triesters of 1,2,4-benzenetricarboxylic acid, also known as trimellitic acid. Preferred esters are tris(2-ethylhexyl)trimellitate, trisisodecyl trimellitate, trisisooctyl trimellitate, tridecyl trimellitate, and trihexadecyl trimellitate. It will be understood that mixed esters such as hexyl, octyl, decyl trimellitate can also be used. Most preferred is tris(2-ethylhexyl)trimellitate (CAS No. 3319-31-1), also known as trioctyl trimellitate, which can be purchased from Eastman Chemical Products, Inc., Kingsport, Tenn., as Kodaflex® TOTM.

Other solvents suitable for the continuous phase of the lubricants of this invention include, among others, those described in U.S. Pat. Nos. 4,293,305; 4,394,126; 4,426,297; 4,581,035; 4,602,916; 4,608,056; and 4,609,375.

The preparation of representative materials described above is given in U.S. Pat. No. 4,529,405, the disclosure of which is herein incorporated by reference.

The procedure for estimating the dye concentrations in the fiber and liquid phases for various parts of the process was calculated according to the following mathematical model. The nomenclature used in the equations that follow is:

Nomenclature $M_f$ = mass fabric
$M_L$ = mass liquid

-continued $C_f$ = concentration of dye in fabric = $\frac{\text{mass dye}}{\text{mass fabric}}$ at time t $C_{f\phi}$ = concentration of dye in fabric = $\frac{\text{mass dye}}{\text{mass fabric}}$ at time t = $\phi$ $C_{f\infty}$ = concentration of dye in fabric = $\frac{\text{mass dye}}{\text{mass fabric}}$ at time t = $\infty$ $C_f^*$ = concentration of dye in fabric = $\frac{\text{mass dye}}{\text{mass fabric}}$ at equilibrium $C_L$ = concentration of dye in liquid = $\frac{\text{mass dye}}{\text{mass liquid}}$ at time t $C_{L\phi}$ = concentration of dye in liquid = $\frac{\text{mass dye}}{\text{mass liquid}}$ at time t = $\phi$ t = time (sec)

$\beta$ = mass transfer coefficient ($sec^{-1}$)

K = equilibrium constant = $\frac{\text{dye concentration in fabric}}{\text{dye concentration in liquid}}$ at equilibrium L = liquid to fabric ratio = $\frac{\text{mass liquid}}{\text{mass fabric}} = M_L/M_F$ The basic equations in this model are as follows:

Basic Equations

1. Phase mass balance:
dye absorbed by fabric=dye lost by liquid $$M_f(C_f-C_{f\phi})=M_L(C_{L\phi}-C_L)$$

2. Equilibrium:
concentration of dye in fabric at equilibrium is proportional to concentration of dye in liquid $$C_f^*=KC_L$$

3. Mass Transfer Rate:
rate=constant x concentration driving force $$-dC_f/dt=\beta(C_f-C_f^*)$$

After applying the appropriate substitutions, algebraic manipulations, and integration, the following formulas are derived. The equations given below are for the typical case where $C_{f\phi}$ (fabric is initially undyed). The general equations for $C_{f\phi}=\phi$ have also been derived and would be for, e.g., multiple contact stages or corrective over-dyeing.

4. Concentration of dye in fabric at time t=∞:

$$C_{f\infty}=\frac{KC_{L\phi}}{1+K/L}$$

5. Relative Concentration of dye in fabric at time t:

$$C_f/C_{f\infty}=1-e^{-(1+K/L)\beta t}$$

6. Concentration of dye in liquid at time t:

$$C_L=C_{L\phi}-C_f/L$$

The invention is further illustrated with reference to the following examples in which all parts and percentages are by weight and temperatures reported in degrees F. unless otherwise indicated.

EXAMPLE 1

Swatch Dyeing of Suraline Polyester Fabric

A dye composition (500 g) consisting of 0.531% OWB crude Disperse Blue 56 in tris(2-ethylhexyl)-trimellitate was stirred and heated to 200° F. in a beaker open to the air atmosphere. Samples of Suraline polyester fabric were first padded in the dye composition to approximately 57% wet pick-up and then were placed on a pin-frame and heated in an oven at 380° F. in an air atmosphere for times ranging from 90 to 180 seconds. The samples were then rinsed in perchloroethylene to remove excess dye composition. The sample colors closely approximated standard samples prepared by immersion dyeing. There was no evidence of dye composition degradation.

EXAMPLE 2

Swatch Dyeing of Cordura High-Tenacity Nylon Fabric

A dye composition (500 g) consisting of 1.23% OWB crude Disperse Blue 56 in tris(2-ethylhexyl)trimellitate was stirred and heated to 200° F. in a beaker open to the air atmosphere. Samples of high-tenacity nylon 6,6 fabric (Cordura®, DuPont) were first padded in the dye composition to approximately 50% wet pick-up then were placed on a pin-frame and heated in an oven at 380° F. in an air atmosphere for approximately 85 seconds. The samples were then rinsed in perchloroethylene to remove excess dye composition. The sample colors closely approximated standard samples prepared by immersion dyeing. There was no evidence of dye composition degradation.

EXAMPLE 3

Continuous Full-Width Dyeing Cordura Nylon Olive Green 106

Approximately 25 gallons of the following dye composition was prepared:

| Component | Concentration (% OWB) |
|---|---|
| crude Disperse Yellow 3 | 3.94 |
| crude Disperse Red 91 | 1.74 |
| crude Disperse Blue 56 | 0.72 |
| tris(2-ethylhexyl)trimellitate | 93.60 |

The dye composition was stirred and heated to 270° F. in a steam-jacketed tank and then was continuously circulated through a pad trough. The temperature of the composition in the pad trough was approximately 235° F. Both the tank and the pad trough were open to the air atmosphere. High-tenacity nylon 6,6 fabric (Cordura®, DuPont, 50 yards) was continuously padded in the heated dye composition to approximately 39% wet pick-up and heated in a tenter oven at 390° F. in an air atmosphere. The fabric dwell time in the oven was 40 seconds which after initial heat-up provided a fabric temperature of 390° F. for approximately 30 seconds. Samples were cut from the fabric and rinsed in acetone to remove excess dye composition. The dyed fabric samples matched the target Olive Green 106 shade. There was no evidence of dye composition degradation.

EXAMPLE 4

Swatch Dyeing from N-methyl-2-pyrrolidone

A dye composition (250 g) consisting of 2.00% OWB crude Disperse Blue 56 in N-methyl-2-pyrrolidone (b.p. 396° F.) was prepared in a beaker at room temperature. Samples of Suraline polyester and Cordura nylon fabrics were padded in the dye composition to wet pick-ups of 174% and 79%, respectively. The samples were then heated in an oven at 390° F. in an air atmosphere for 120 seconds and rinsed in acetone to remove excess dye composition. The dyed samples exhibited a high color yield. There was no evidence of dye composition degradation.

What is claimed is:

1. A process for continuously dyeing a textile fabric with a non-aqueous dye composition at an elevated temperature in an air atmosphere comprising the steps of:

(a) applying a dye composition comprising a substantially non-aqueous, high-boiling nonionic solvent and a dyestuff to a textile in an air atmosphere and in an amount sufficient to entrain the dye composition in the textile, the dye composition maintained at a temperature below 280° F.; and (b) heating the dye composition-entrained textile fabric in an ambient atmosphere to a temperature and for a period of time sufficient to effectuate dyeing of the textile.

2. The process of claim 1 including the additional step of (c) rinsing the dyed textile to remove any residual dye composition remaining on the textile.

3. The process of claim 2 including the additional step of (d) washing the dye textile with an aqueous soaping solution.

4. The process of claim 3 including the additional step of (e) drying the dyed textile.

5. The process of claim 2 in which the dyed textile is washed in step (c) with an organic solvent.

6. The process of claim 1 in which the textile fabric is heated in step (b) to a temperature in the range of about 300° to about 430° F. and for a period of time less than 120 seconds.

7. The process of claim 6 in which the textile fabric is heated in step (b) for a period from about 20 to about 60 seconds.

8. The process of claim 1 in which the textile fabric is dimensionally stabilized during step (b).

9. The process of claim 1 in which the textile fabric is polyester.

10. The process of claim 1 in which the textile fabric is nylon.

11. The process of claim 10 in which the nylon is high-tenacity nylon.

* * * * *